United States Patent [19]

Bennett et al.

[11] 4,366,895

[45] Jan. 4, 1983

[54] HANDLING ROD-LIKE ARTICLES

[75] Inventors: George R. Bennett; Robert S. Day, both of Deptford, England

[73] Assignee: Molins Limited, London, England

[21] Appl. No.: 90,432

[22] Filed: Nov. 1, 1979

[30] Foreign Application Priority Data

Nov. 1, 1978 [GB] United Kingdom ..... 7842710

[51] Int. Cl.[3] ..... B65G 1/00

[52] U.S. Cl. ..... 198/347; 198/425

[58] Field of Search ..... 198/347, 425, 532, 631, 198/812, 616, 491, 529, 525, 535; 222/339, 415, 544; 221/253, 224; 53/148, 236; 193/2 B

[56] References Cited

U.S. PATENT DOCUMENTS

| | | | |
|---|---|---|---|
| 1,666,908 | 4/1928 | Moore | 222/544 X |
| 3,426,885 | 2/1969 | R upert | 198/616 X |
| 3,545,593 | 12/1970 | Wallenborn | 198/535 |
| 4,201,507 | 5/1980 | Hinchcliffe et al. | 198/347 X |

FOREIGN PATENT DOCUMENTS

| | | | |
|---|---|---|---|
| 1175356 | 12/1969 | United Kingdom | 193/2 B |
| 1374999 | 11/1974 | United Kingdom . | |

*Primary Examiner*—Robert B. Reeves
*Assistant Examiner*—Douglas D. Watts
*Attorney, Agent, or Firm*—Antonelli, Terry & Wands

[57] ABSTRACT

A device for separating a stream of rod-like articles in stack formation by projection in a direction transverse to the lengths of the articles comprises a movable support for guide means around which passes at least one flexible band. As the device is projected through the stream the part of the band in contact with the articles is held stationary thus minimising disturbance of and possible damage to the articles. The device may be used to close off an opening through which a container is loaded or unloaded and may be used to separate a horizontally moving stream into batches.

23 Claims, 7 Drawing Figures

HANDLING ROD-LIKE ARTICLES

Figure 1:
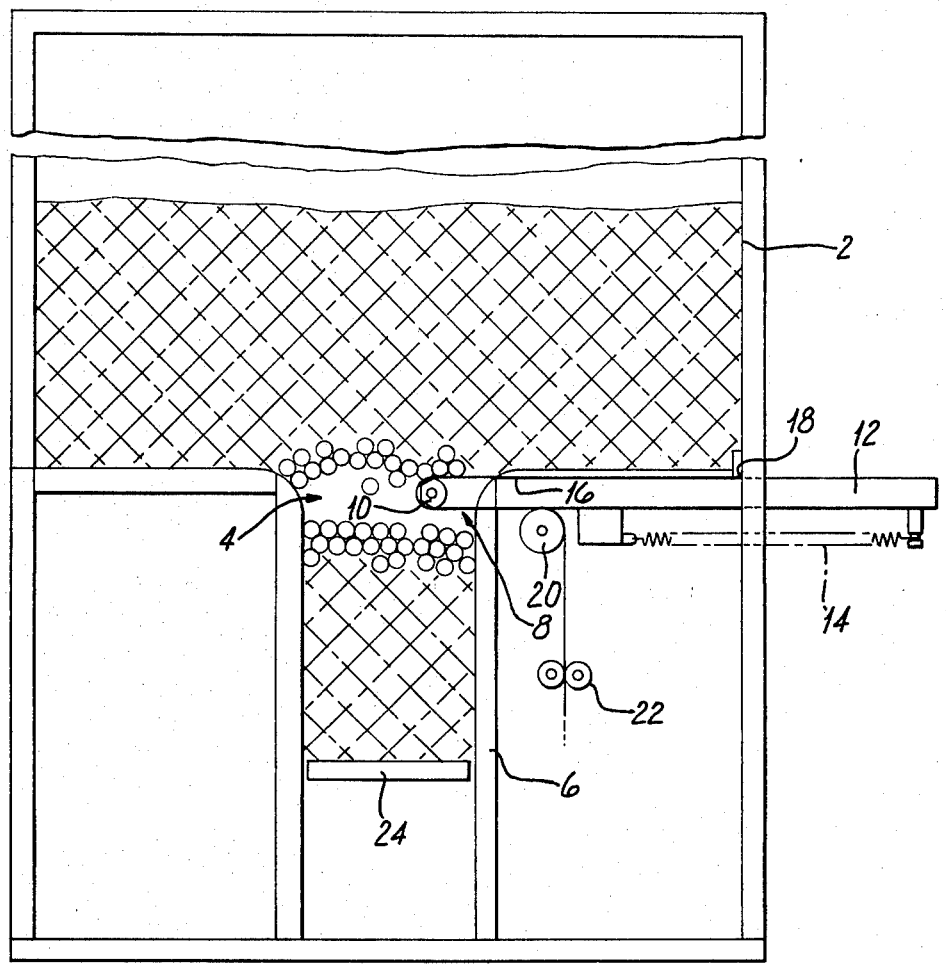

This invention relates to apparatus for handling rod-like articles, particularly cigarettes and cigarette filter rods. In the tobacco industry it is often required to move cigarettes or cigarette filter rods between processing machines. For example, cigarettes have to be transported from a cigarette making machine to a cigarette packing machine. Similarly filter rods are moved from a filter rod making machine to a filter cigarette assembling machine which joins filters to tobacco lengths. It is often convenient to move the articles in stack formation in a direction transverse to their lengths. It is sometimes required to divide such a stack into batches, e.g. for insertion of batches into a container as disclosed in British Pat. No. 1,404,141, or to otherwise separate or isolate articles in stack formation.

According to one aspect of the invention a method of separating rod-like articles in stack formation comprises projecting a separating device in a direction transverse to the articles of the stack so that at least one side of the device in contact with the articles remains stationary relative to the articles. By adopting this method friction in inserting the device may be reduced to a minimum and rubbing against the articles can be avoided. Thus possible damage to and disturbance of the articles is also avoided.

Apparatus for separating a stack of rod-like articles according to the invention may comprise means defining a path for rod-like articles in stack formation, a separating device including guide means for at least one flexible band, means for moving the device into said path, and means for holding said band stationary relative to the articles on one side of the guide means as the device is moved into said path. The device may comprise support means for said band behind that part of the band which is held stationary relative to said articles.

The guide means may comprise at least one pulley around which the band passes. Laterally-spaced bands with guide means comprising two or more laterally-spaced pulleys could be provided. The position and movement of the pulley or pulleys can be controlled directly, e.g. by a pneumatic piston assembly, or by movement of the band or bands. The latter may be held stationary (relative to the articles) by being fixed at one end or, if an endless band is used, by holding stationary a pulley around which the band passes. In this case the band also passes around tensioning means which allows movement of the separating device whilst part of the band remains stationary.

The means defining a path for the rod-like articles may comprise conveyor means and may confine the articles above and below (or at both sides of) the stack. Where it is required to separate a stack which may be substantially continuous and which is substantially confined, means may be provided to facilitate entry of the separating device. Such means could consist of means for increasing the available volume adjacent the device, either by moving articles away or by temporarily removing the confinement of the articles in the region of the device.

The separating device may be withdrawn so that a continuous stack can be assembled or reassembled on the path. Normally, but not necessarily, said one side of the band is kept stationary during withdrawal of the device.

One use for the present apparatus is to divide a stream of rod-like articles on a substantially horizontal conveyor into batches. For example, the separating device can be arranged so that it may be projected upwards laterally-spaced bands of a stream conveyor. In this arrangement it is preferable for both sides of the separating device to remain stationary relative to the articles in the stream so that the device causes minimum disturbance to the stream as it is projected upwards. Thus the separating device may comprise at least two separate bands and guide means, so that the outer sides of the device in contact with the articles comprise stationary parts of the respective bands. The moving parts of the bands pass between the stationary outer parts.

Another use for the separating device is in association with a chute or elevator for rod-like articles, where the device may be used as a gate which is movable substantially horizontally to prevent passage of articles. Opposed separating devices on opposite sides of the path may cooperate to close the gate. A pivoted bridge piece or other closure element could be provided to fill any gap between the confronting ends of the separating devices. Alternatively each device may comprise laterally spaced guide means for laterally spaced bands, the respective guide means being offset so that the devices may effectively overlap. Alternatively, or additionally, the devices may be at different levels and may overlap in their closed position. The space between the lower band of the upper device and the upper band of the lower device may conveniently be about one article diameter in this position. One important application of the use of one or more separating devices to close an opening at the upper end of a chute or elevator is where a container may be loaded or unloaded through said opening. For example, the separating device may be used to close the opening after a container has been filled by rod-like articles moved upwards into the container by means of an elevator.

According to another aspect of the present invention apparatus for loading and unloading a container comprises means for holding a container over an opening through which a stack of rod-like articles may be passed to or from the container, a separating device as previously described for closing said opening, and conveyor means for moving a stack of articles to or from the opening.

When it is required to insert the separating device to block the opening after the container has been loaded with articles, the conveying means may be temporarily reversed to allow insertion of the separating device. Reversal of the conveyor means may be under control of a photo-sensor which detects when a void has been created in the stream of articles. Preferably the opening is closable by means of opposed separating devices having associated bands which have upper runs which may be driven during loading or unloading of the container to move articles away from or towards the opening. The upper runs of the bands are held stationary during insertion of the separating devices.

In a preferred arrangement the container comprises a portable tray which may be moved to and from the loading/unloading position by rotation about an axis parallel to the rod-like articles. The arrangement may be similar to that disclosed in U.S. patent application Ser. No. 855775. The separating devices (and their associated bands) are preferably rotatable about the same axis as the tray.

Figure 2:
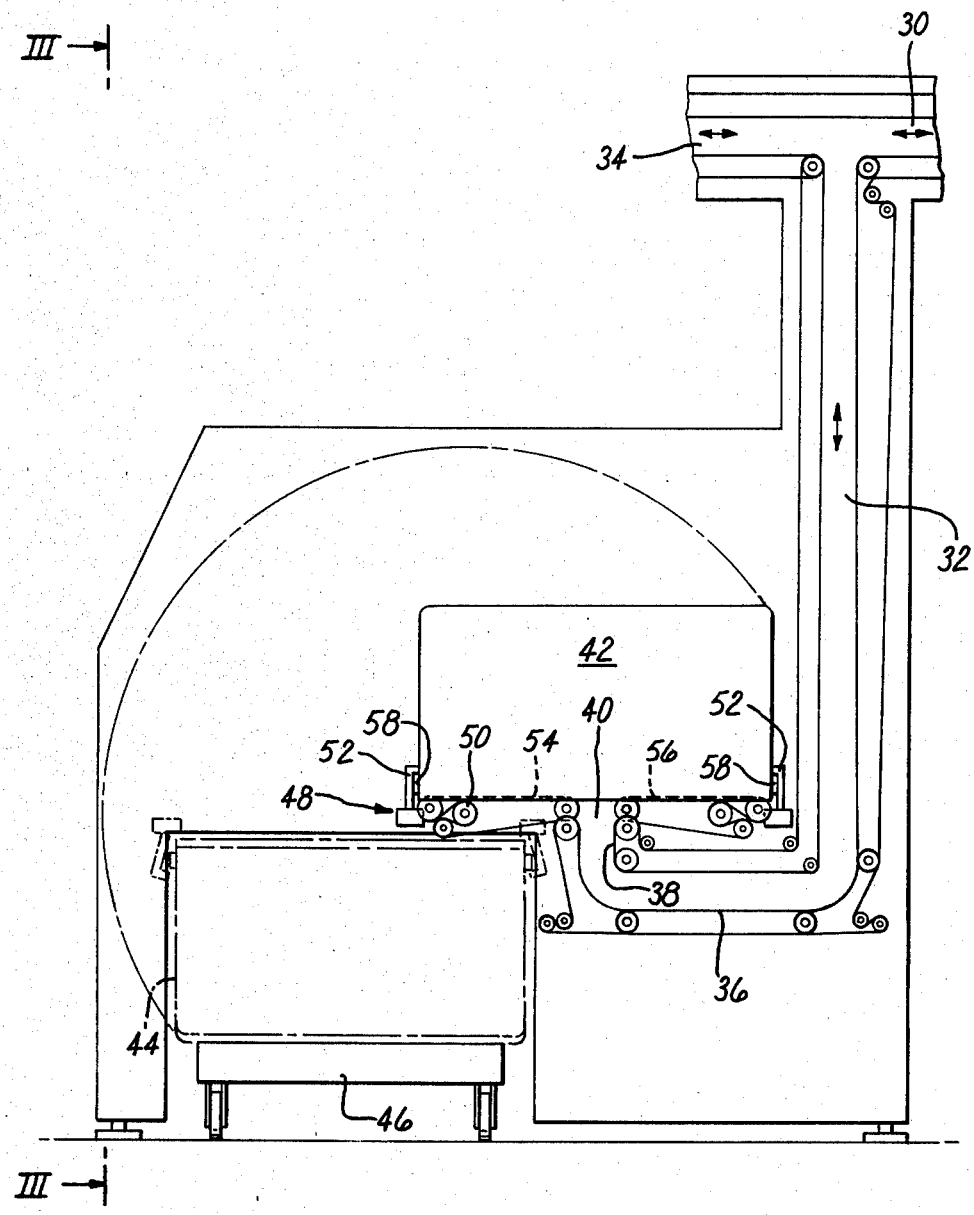
Figure 3:
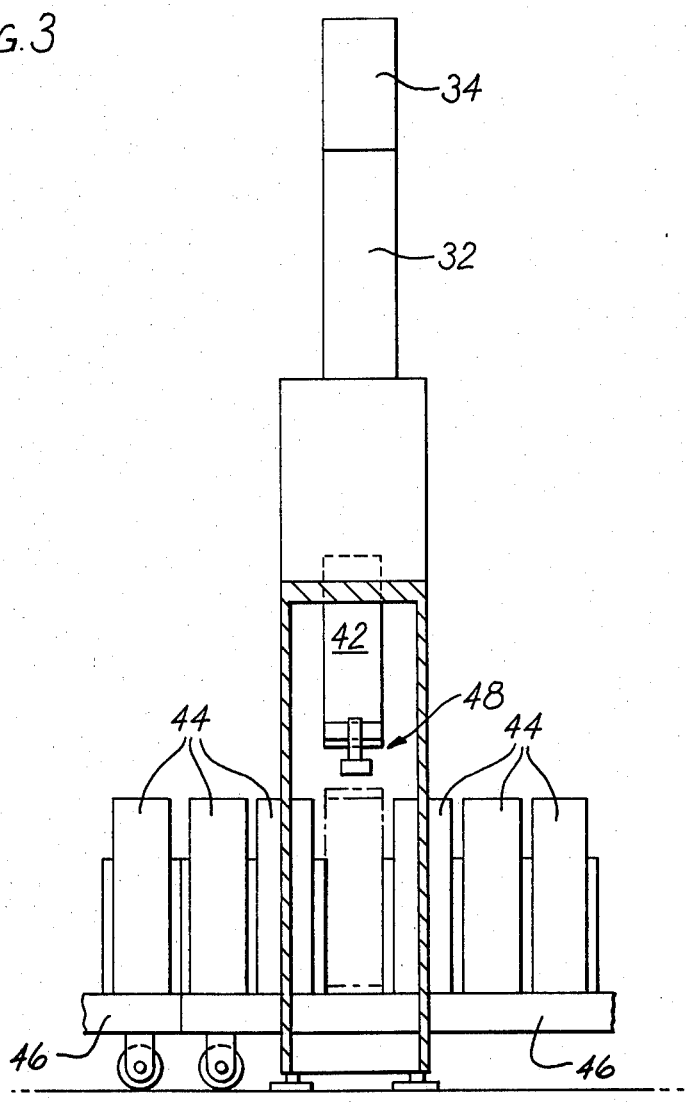
Figure 4:
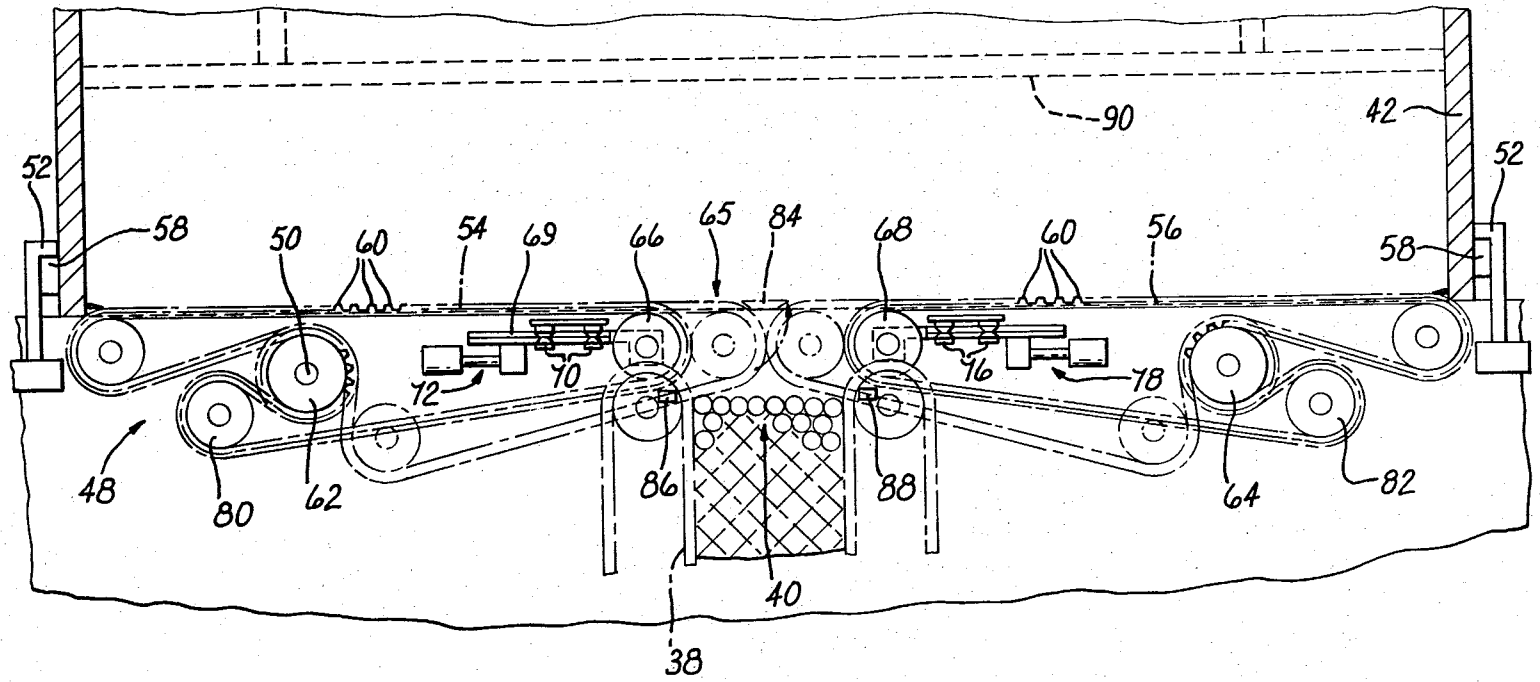
Figure 5:
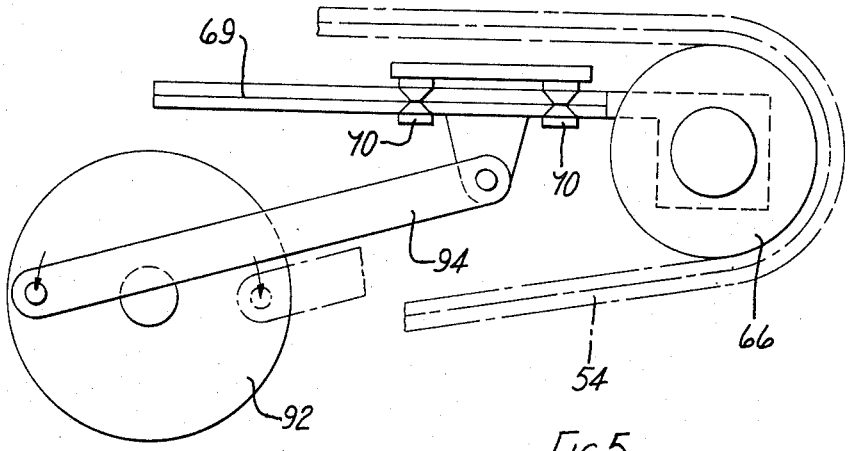
Figure 6:
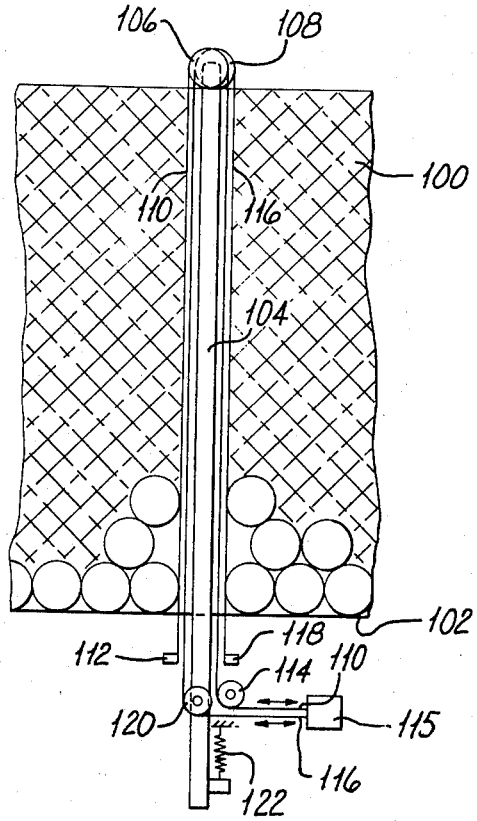
Figure 7:
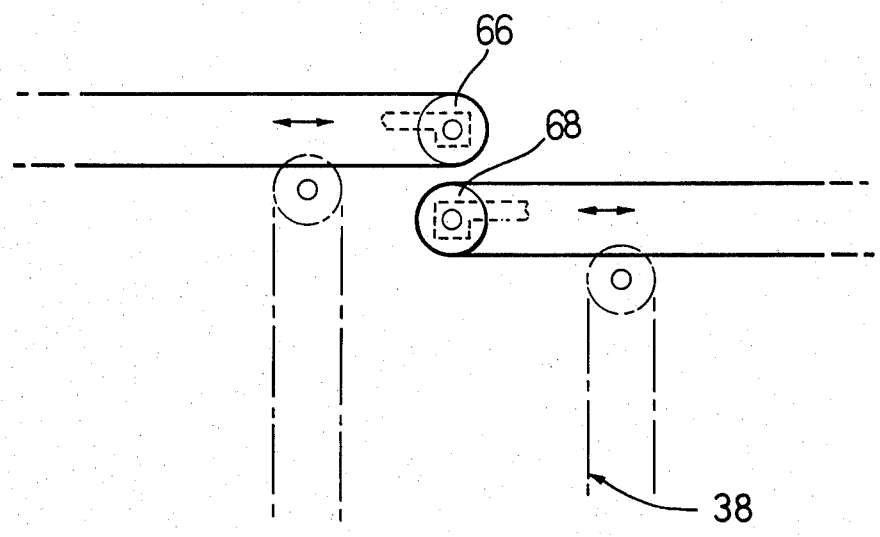

The invention will be further described, by way of example only, with reference to the accompanying diagrammatic drawings, in which:

FIG. 1 is a side view of apparatus for handling rod-like articles, incorporating a gate, FIG. 2 is a side view of tray loading and unloading apparatus, FIG. 3 is a part-sectional view on the line III—III of FIG. 2, FIG. 4 is an enlarged side view of part of the apparatus of FIG. 2, FIG. 5 is an enlarged view of a detail modification of the apparatus of FIG. 2, FIG. 6 is a side view of apparatus for dividing a stream of rod-like articles, and FIG. 7 is a side view showing a modified arrangement of the apparatus of FIG. 4.

FIG. 1 shows apparatus for handling rod-like articles, including a container 2 having an outlet 4 leading to a chute 6. The outlet 4 is closable by means of a gate, generally indicated at 8. The gate 8 comprises a pulley 10 mounted on a horizontally-slidable support 12 which is biased by a tension spring 14 towards a position at which the support extends across the outlet 4. A band 16 fixed at one end 18 passes over the support 12, around the pulley 10, and around a further pulley 20 to reversible drive means 22. A platform 24 for supporting rod-like articles is reversibly movable in the chute 6.

The gate 8 can be operated to block the outlet 4 and isolate the articles in the container from those in the chute 6. For example, when articles are passing out of the container 2 through the chute 6, e.g. by controlled descent of the platform 24, the drive means 22 may be actuated to release the band 16 at a controlled speed. This allows the tension spring 14 to advance the support 12 and pulley 10 across the outlet 4. As the pulley 10 advances minimal disturbance is caused to the articles in the container 2 since the upper run of the band 16 (which covers, or at least shields, the support 12) remains stationary. When the gap across the outlet 4 has been reduced to a critical width, which depends on the diameter and nature of the articles, lateral "bridging" of the articles may occur (as indicated in the drawing). Further passage of the gate 8 across the outlet 4 does not disturb this "bridge", again because of the stationary upper run of the band 16. If there is any tendancy for an article to remain in the path of the gate 8 as it nears the opposite side of the outlet 4 the movement of the band 16 around the pulley 10 tends to displace the article upwards out of the path of the gate so that it will not be crushed. In order to aid insertion of the gate 8 the platform 24 may be arranged to continue its descent in the chute 6 for a short period after insertion of the gate has started. Once the "bridging" effect referred to above has occurred further descent of the platform 24 is unnecessary.

The gate 8 is also usable to isloate the container 2 after being supplied with articles through the chute 6, e.g. by upward movement of the platform 24. In this case the movement of the platform 24 may be reversed for a short period during initial insertion of the gate 8.

The gate 8 is removed to open the outlet 8 by operating the drive means 22 to move the band of 16 so that the pulley 10 and support 12 are withdrawn against the tension of spring 14.

The gate 8 could be moved by direct action on the support 12, e.g. by means of a pneumatic piston, in conjunction with tensioning means for the band 16, instead of by the spring 14 and drive means 22 for the band.

The tray loading and unloading apparatus shown in FIGS. 2 to 4 comprises conveyor means 30 for delivering a stack of rod-like articles to a junction with a stack elevator 32. A reversible reservoir conveyor section 34 also connects with the junction. The elevator 32 leads down to a short horizontal conveyor section 36 beyond which is a further elevator 38. The conveyors and elevators 30–38 comprise opposed laterally spaced bands (which may be provided with spaced protrusions). The construction and operation of an elevator for a stack of rod-like articles is described and illustrated in British Pat. No. 1,453,193. The elevator 38 terminated at an outlet 40 over which a tray 42 may be inverted for loading or unloading.

Trays 44, similar to the tray 42, are delivered to and removed from the apparatus on trolleys 46 which move on a path generally parallel to the articles in the elevator 38. Trays 44 are moved to and from the loading/unloading position of the tray 42 by means of a support assembly 48 which is rotatable about an axis 50. The assembly 48 includes a pair of latches 52 and also carries bands 54, 56. The latches 52 are pivotable to engage lugs 58 on each side of a tray 42, 44, and also movable upwards relative to the support assembly 48, so that when the assembly is positioned above a tray 44 on a trolley 46 the tray may be lifted clear of the trolley and clamped to the assembly. The required movement of the latches 52 could be achieved by means of air cylinders and/or cam means. The slight lifting of the tray 44, indicated by chain dot lines in FIG. 2, allows the assembly 48 to rotate about the axis 50 whilst carrying the tray and ensures that the latter will clear the trolley 46 during rotation. The support assembly 48 thus moves a tray 44 from a trolley 46 into the position of tray 42 for loading or unloading. After the tray 42 has been loaded or unloaded it is returned by reverse rotation of the support assembly 48 and released by the latches 52 for delivery onto the trolley 46.

The trolley 46 is indexed one position forwards or backwards (normally depending on whether the apparatus is in a loading or unloading mode) to bring another tray into alignment with the support assembly 48. One form of suitable trolley-indexing mechanism is described and illustrated in British Pat. No. 1,117,236. As indicated in FIG. 3 successive trolleys 46 may be moved in abutment so that the spacing between trays 44 is constant. The trolleys 46 may be maintained in abutment and correctly oriented by means of magnets of opposite poles at the front and rear of each trolley. Aligning means comprising pegs and sockets may be used to provide lateral positioning of the trolleys 46 relative to one another.

The loading and unloading of a tray 42 will be described with particular reference to FIG. 4. The tray 42 is clamped to the support assembly 48 by latches 52, and is located just above the outlet 40 of the elevator 38. The bands 54, 56 are positioned beneath the open top of the inverted tray 42. For convenience each band 54, 56 will be referred to as a single band but in fact the bands 54, and 56 each comprise a pair of laterally spaced bands located just inside the planes of the laterally spaced bands of the elevator 38. The bands 54, 56 (and also the bands of elevator 38) are formed with moulded teeth 60 which serve to engage with respective drive pulleys 62, 64 for the bands, and also to provide additional driving contact between the bands and the rod-like articles. For the latter purpose the recesses between the teeth 60 are preferably of appropriate size to seat a single rod-like article.

In the region just above the outlet 40 the bands 54, 56 pass around respective pairs of confronting pulleys 66, 68 which, in the position shown in full lines in FIG. 4, define an opening of about the same width as the outlet 40. As explained below this opening may be closed by a gate indicated generally at 65 and including the pulleys 66, 68. The pulleys 66 are rotatably mounted on a slide 69 which is adapted to run in pairs of V-groove rollers 70 (only one pair of which is shown in the drawing). The position and movement of the slide 69, and therefore of the pulley 66, is controlled by a pneumatic piston assembly 72. Similarly, the pulleys 68 are mounted on a slide 74 movable relative to rollers 76 by a piston assembly 78. The pulleys 66 and 68 are movable under action of the respective piston assemblies 72, 78 between the position shown in full and dotted lines in FIG. 4, i.e. between open and closed positions of the gate 65 respectively. In order to accomodate the movement of the pulleys 66, 68 the bands 54, 56 pass around tensioning pulleys 80, 82 which are pivotally movable about the axes of drive pulleys 62 and 64 respectively, as indicated in FIG. 4.

There is still a slight gap between the upper runs of the bands 54, 56 when the pulleys 66, 68 are close to one another. A pivoted bridge piece 84, movable as indicated in the drawing as the pulleys 66, 68 move together (e.g. by cam means synchronised with the piston assembly 72) is provided for filling this gap.

A light source 86 and photo-detector 88 are positioned on opposite sides of the outlet 40 just below the gate 65.

When the apparatus is used as a tray unloader a full tray on the trolley 46 is picked up by the support assembly 48 and rotated with it about the axis 50 to the position of the tray 42, in FIG. 4. Prior to and during rotation of the assembly 48 the gate 65 is closed so that the pulleys 66, 68 are in their positions of closest proximity and the bands 54, 56 and bridge piece 84 close the open top of the tray. After rotation of the tray and assembly 48 the pulleys 66, 68 are moved apart and the bridge piece 84 pivoted away, thereby opening the gate 65. Subsequently, the bands 54, 56 are driven by their respective pulleys 62, 64 so that their runs move towards one another and articles in the tray 42 are moved towards and through the open gate 65 into the outlet 40. The elevators 38 and 32 and conveyors 36 and 30 are driven to move articles away from the unloading tray 42. Drive of the bands 54, 56 and the elevator 38 etc. continues until the detector 88 in the outlet 40 is uncovered, thereby indicating that the tray 42 is empty. It is desirable to speed up the bands 54, 56 when the tray is about three-quarters empty, to move articles more rapidly towards the central opening of the gate 65 to prevent a void forming in this region.

When the tray is empty the pulleys 66, 68 are moved together to close the gate 65 and the tray 42 is returned to the trolley 46 and released by the assembly 48. Assuming that the apparatus is still required to unload trays, the trolley 46 is then indexed one position to move the next full tray into place for pick-up by the assembly 48.

When the apparatus is used as a tray unloader an empty tray is picked up by the assembly 48 and moved to the position of the tray 42 in FIG. 4. As before, the pulleys 66, 68 are adjacent during movement of the assembly 48 and are subsequently moved apart (and the bridge piece 84 pivoted away) to open the gate 65. During loading, the bands 54, 56 elevators 38 and 32, and conveyors 30 and 36 are driven to move articles to and through the outlet 40 and into the empty tray 42. The movement of the upper runs of bands 54, 56 away from one another causes the articles to spread out within the tray.

The bottom of each tray 42, 44 is provided with a slot to provide access for a sensor bar, indicated at 90 in FIG. 4, which is attached to mechanism within the apparatus and is arranged to rest lightly on the top layer of articles as the tray is filled. The bar 90 follows the upward movement of the articles in the tray and helps to maintain the upper surface level. When the bar 90 reaches an upper limit position, indicating that the tray is full, it is withdrawn upwards through the slot and the band 54, 56 and elevator 38 etc. are stopped. The sensor bar 90 can also be used during unloading when it can help keep the descending surface of the articles level and indicate when it is necessary to speed up the bands 54, 56. The construction and use of a sensor bar is described and illustrated in British Pat. No. 1,339,887.

After the bands 54, 56 and elevator 38 etc. have been stopped when the tray 42 is full, the pulleys 66 and 68 are advanced towards one another in order to close the gate 65. At the same time the elevator 38, conveyor 36 and elevator 32 are driven to move articles away from the outlet 40, this creating a void to allow entry of the pulleys 66, 68. The reversible reservoir 34 accommodates this reverse flow of articles. The reverse movement of the elevator 38 etc. continues until light from the source 86 reaches the photo-cell 88. This ensures a loosening of the articles in the region above the outlet 40 to allow the pulleys 66, 68 to move towards one another. As with the embodiment of FIG. 1, once the pulleys 66, 68 are sufficiently close together, the articles "bridge" the gap naturally and a void is created below the pulleys. It is at this stage that the reverse flow of the elevator 38 etc. will normally stop. The pulleys 66, 68 can then advance freely to completely close the gate 65 (together with the bridge piece 84). The upward movement of the bands 54, 56 around the pulleys 66, 68, respectively, helps to prevent any article becoming trapped between the pulleys. Since the upper runs of the bands 54, 56 remain stationary during movement of the pulleys 66, 68 there is minimum disturbance to the articles in the tray 42.

Once the gate 65 has been closed the assembly 48 may be rotated about its axis 50, in order to return the tray 42 to the trolley 46. The trolley 46 may then be indexed to position another empty tray under the support assembly 48, for clamping to the assembly and subsequent rotation to the loading position.

The conveyor 30 may form part of (or be connected to) a conveyor system linking one or more article producing machines (e.g. cigarette making machines) to one or more article receiving machines (e.g. cigarette packing machines). The apparatus can operate as a tray loader or as a tray unloader as necessary according to conditions in the conveyor system (as indicated by the producing and receiving machines). If necessary the apparatus can reverse between its tray loading and tray unloading modes during operation on one tray. The trolleys 46 are preferably movable so that, referring to FIG. 3 for example, full trays are always to the left of the apparatus and empty trays to the right. The trolleys 46 will then be moved in a direction, which depends on the mode of operation of the apparatus, to deliver empty or full trays to the support assembly 48.

Instead of using a bridge piece 84 to close the slight gap between the upper runs of bands 54, 56, the bands and their respective pulleys 66, 68 can be offset so that the bands can overlap when the gate 65 is closed, so that the upper runs of the bands close the gap. For example, the pulleys 66, 68 could be moved towards one another to a position at which their axes are aligned. Alternatively the pulleys 66, 68 could be at different levels so that they can overlap, as seen in FIG. 7. In this case the gap between the lower run of the upper band and the upper run of the lower band is preferably about one article diameter; this should avoid any possible damage to articles as the gate is closed.

Another possible modification of the apparatus of FIGS. 2 to 4 is that one or both of the side conveyors of elevator 38 could be arranged to be movable sideways slightly, to increase the width of the elevator just below the outlet 40 so as to create the necessary void to allow entry of the pulleys 66, 68 during closing of the gate 65 after a tray 42 has been filled. If the apparatus is provided with this modification reversal of the elevator 38 etc. to allow entry of the pulleys 66, 68 is unnecessary.

A further modification of the apparatus of FIGS. 2 to 4, in which the pulleys 66 and slide 69 are moved in rollers 70 by means of a reciprocally-driven wheel 92 and crank 94 is shown in FIG. 5.

The invention may also be adapted for use in dividing a stream 100 consisting of a stack of rod-like articles on laterally-spaced conveyor bands 102, as shown in FIG. 6. A plate 104 is guided for vertical movement between the bands 102 and carrier at its upper end a first pair of laterally-spaced pulleys 106 and a second pair of laterally-spaced pulleys 108. The axes of rotation of the first and second pairs of pulleys 106, 108 respectively, are slightly offset. Bands 110 pass from a fixed position 112, around the pulleys 106, and around a fixed rotatable pulley 114 to reversible drive means 115 for the bands. Similarly, bands 116 pass from a fixed position 118, around the pulleys 118 and further fixed rotatable pulleys 120 to reversible drive means 115 for the bands. The plate 104 is biased upwards, against tension in the bands 110, 116 by means of a tension spring 122.

The plate 104 is movable from a position at which the pulleys 106, 108 are retracted below the level of the bands 102 to an upper position at which the plate is projected through the stream 100 on the bands 102. The position and movement of the plate is controlled by the reversible drive means 115 for the bands 110, 116. As the drive means 115 allows more slack in the band the spring 122 moves the plate upwards thereby maintaining tension in the band. During this movement the side parts of the bands 110, 116 in contact with the articles in the stream 100 remain stationary; this minimises disturbance and degradation of the articles in the stream. The movement of the bands around the pulleys 106, 108 is in opposite directions away from one another during projection of the plate into the stream, so that articles will tend to be moved away from the advancing plate. Conversely, when the plate 104 is withdrawn articles will tend to be moved into the void left by the retracting plate.

Instead of moving the plate by means of the tension spring 122 under controlled movement of the bands 110,116 the plate could be directly moved with the bands being maintained taut by tensioning means.

Although a divider constituted by the present arrangement is probably wider than a conventional divider plate for a stream or rod-like articles (as disclosed, for example, in British Pat. No. 1,404,141), this apparent disadvantage is offset by the minimal disturbance to the stream which this arrangement can achieve due to the stationary side bands and the action of the top pulleys in moving articles out of the path of the divider.

The divider could be made narrower if the pulleys 106, 108 were coaxial. In this case additional pulleys or other guide means could be provided to keep the moving runs of the bands inside the stationary outer runs.

We claim:

1. Apparatus for handling rod-like articles comprising means defining a substantially-continuous path for rod-like articles in multi-layer stack formation, a separating device including guide means and at least one movable surface supported by said guide means, drive means for moving said surface to convey articles on said path, projecting means for movingly projecting said separating device across said path intermediate the ends of said path in a direction transverse to the lengths of the articles on said path and from one side of said path towards the opposite side to locally reduce the width of said path proportionally with said movement, and means for holding at least part of said movable surface stationary in said path as said separating device is moved across said path.

2. Apparatus according to claim 1, wherein the movable surface comprises a flexible band.

3. Apparatus according to claim 2, wherein the separating device includes support means which is progressively projected across said path behind that part of the band which is held stationary relative to said path.

4. Apparatus according to claim 2, wherein the guide means includes at least one pulley around which the band passes.

5. Apparatus according to claim 2, wherein said band is endless, including further movable guide means which cooperate with said guide means to maintain said band in tension.

6. Apparatus for handling rod-like articles, comprising means defining a substantially-continuous path for rod-like articles in stack formation, a separating device including guide means and at least one movable surface, drive means for moving said surface to convey articles on said path, projecting means for projecting said device across said path in a direction transverse to the lengths of the articles on said path, and means for holding at least part of said surface stationary relative to said path as said device is moved across said path, said separating device including opposed parts on opposite sides of said path which parts cooperate to close said path and wherein each of said parts comprises a flexible band and guide means around which the band passes, the guide means for the respective bands being relatively offset so that said bands may overlap when projected across said path.

7. Apparatus for handling rod-like articles, comprising a substantially vertical channel defining a path for rod-like articles in stack formation, means for holding a container over said channel, means for conveying articles along said channel, a separating device arranged adjacent the upper end of said channel and including guide means and at least one movable surface, means for projecting said device across said path in a direction transverse to the lengths of the articles on said path, means for holding at least part of said surface stationary relative to said path as said device is moved across said path, said device including opposed parts for closing said channel, said parts including associated bands which have upper runs which are engaged by said holding means, and means for moving said holding means to drive said upper runs to move articles within the container.

8. Apparatus for handling rod-like articles comprising means defining a path for rod-like articles in multi-layer stack formation, a separating device including guide means and at least one movable surface, means for moving said surface to convey articles on said path, means for movingly projecting said device across said path intermediate the ends of said path in a direction transverse to the lengths of the articles on said path and from one side of said path towards the opposite side to locally reduce the width of said path proportionally with said movement, and means for holding at least part of said surface stationary in said path as said device is moved across said path, wherein said path includes portions of different widths and opposed transitions between said portions, at least one of said transitions comprising said separating device which is arranged to close the path of lesser width.

9. Apparatus for handling rod-like articles, comprising means defining a substantially-continuous path for rod-like articles in stack formation, a separating device including guide means and at least one movable surface supported by said guide means, drive means for moving said surface to convey articles on said path, and projecting means for movingly projecting said separating device across said path in a direction transverse to the lengths of the articles on said path by progressively increasing the length of said device as that at least part of said surface is stationary relative to said path as said separating device is moved across said path.

10. Apparatus for handling rod-like articles, comprising means defining a path for rod-like articles in stack formation, opposed separating devices each including rotary guide means and at least one flexible movable surface, drive means for moving said surface to convey articles on said path, projecting means for movingly projecting said separating devices towards each other across said path simultaneously and from opposite sides thereof in a direction transverse to the lengths of the articles on said path, the respective guide means and movable surfaces of the devices being relatively offset so that the innermost parts of the devices may overlap to close said path, and means for holding at least part of each of said surfaces stationary relative to said path as said devices are moved across said path.

11. Apparatus for handling rod-like articles, comprising means defining a substantially-continuous path for rod-like articles in multi-layer stack formation, a separating device including guide means and at least one flexible band supported by said guide means, projecting means for movingly projecting said separating device across said path intermediate the ends of said path in a direction transverse to the lengths of the articles on said path and from one side of said path towards the opposite side by progressively increasing the transverse length of said device so as to locally reduce the width of said path proportionally with said movement, and means for holding at least part of said band stationary in said path as said separating device is moved across said path, wherein said path defining means includes opposed surfaces extending alongside said path adjacent said separating device, and driven means is provided for moving at least one of said surfaces to facilitate entry of said separating device by allowing displacement of articles on said path by said separating device.

12. Apparatus according to claim 8, wherein said band is fixed at one end relative to said path.

13. Apparatus according to claim 11, wherein said driven means includes means for moving at least one of said surfaces in a transverse direction relative to said path to increase the width of said path adjacent said device.

14. Apparatus according to claim 11, wherein said driven means including means for moving at least one of said surfaces to convey articles along said path and away from the region of said device.

15. Apparatus according to claim 1, wherein said means defining said path comprises a substantially vertical channel, said separating device being arranged adjacent the upper end of said channel.

16. Apparatus according to claim 15, including means for holding a container over said channel, and means for conveying articles along said channel.

17. Apparatus according to claim 9, wherein said defining means includes a container for rod-like articles and a channel connected to said container, said movable surface being arranged to convey articles between said container and said channel

18. Apparatus according to claim 17, wherein said movable surface is arranged to convey articles in a direction transverse to their direction of conveyance in said channel

19. Apparatus according to claims 9, 17 or 18, wherein said separating device includes opposed movable surfaces and said moving means is arranged to move said surfaces to convey articles in directions generally towards each other.

20. Apparatus according to claim 17, wherein said upper runs of said bands are respectively arranged on opposite sides of said channel and are arranged to convey articles in said container towards said channel when said separating device is not projected across said path.

21. Apparatus according to claim 10, wherein said respective guide means are laterally offset relative to said path, said parts of said surfaces which are held stationary being substantially coplanar.

22. Apparatus according to claim 10, wherein said respective guide means are offset in the conveying direction of said path, so that said parts of said surfaces which are held stationary are spaced in said direction.

23. Apparatus according to claim 1, wherein said separating device comprises opposed parts on opposite sides of said path which parts are movable together to close said path.

* * * * *